US006801109B2

(12) United States Patent
Simms

(10) Patent No.: US 6,801,109 B2
(45) Date of Patent: Oct. 5, 2004

(54) TRANSFER SWITCH INCLUDING A CIRCUIT BREAKER HOUSING

(75) Inventor: Kevin A. Simms, Houston, PA (US)

(73) Assignee: Eaton Corporation, Cleveland, OH (US)

( * ) Notice: Subject to any disclaimer, the term of this patent is extended or adjusted under 35 U.S.C. 154(b) by 215 days.

(21) Appl. No.: 10/003,133

(22) Filed: Nov. 15, 2001

(65) Prior Publication Data

US 2003/0090348 A1 May 15, 2003

(51) Int. Cl.[7] ..... H01H 77/00; H01H 83/00
(52) U.S. Cl. ..... 335/14; 335/20
(58) Field of Search ..... 335/14, 20, 166–176

(56) References Cited

U.S. PATENT DOCUMENTS 4,167,716 A * 9/1979 Horn ..... 335/14
4,725,799 A * 2/1988 Bratkowski et al. ..... 335/14
4,849,590 A * 7/1989 Becker et al. ..... 218/33
4,864,262 A * 9/1989 Deb ..... 335/20
5,301,083 A 4/1994 Grass et al.
5,331,301 A * 7/1994 Glennon et al. ..... 335/20
5,373,411 A 12/1994 Grass et al.
5,397,868 A 3/1995 Smith et al.
6,414,575 B1 * 7/2002 Swift ..... 335/6
6,570,269 B2 * 5/2003 McMillan et al. ..... 307/64
2003/0193381 A1 * 10/2003 Davidson et al. ..... 335/14

* cited by examiner

*Primary Examiner*—Lincoln Donovan
*Assistant Examiner*—Bernard Rojas
(74) *Attorney, Agent, or Firm*—Martin J. Moran

(57) ABSTRACT

A transfer switch includes a miniature circuit breaker housing, a first line terminal, a second line terminal and a load terminal. A transfer arm is adapted to pivot between a first position in which the transfer arm is electrically connected to the first line terminal and a second position in which the transfer arm is electrically connected to the second line terminal. A solenoid having a first coil, a second coil and a plunger moves the transfer arm between the first and second positions thereof. Separable contacts are electrically connected between the transfer arm and the load terminal. An operating mechanism opens and closes the separable contacts.

2 Claims, 3 Drawing Sheets

TRANSFER SWITCH INCLUDING A CIRCUIT BREAKER HOUSING

CROSS-REFERENCE TO RELATED APPLICATION

This application is related to commonly assigned U.S. patent application Ser. No. 10,003,221, filed Nov. 15, 2001, entitled "Transfer Switch Including A Circuit Breaker Housing" (Attorney Docket No. 01-EDP-258).

BACKGROUND OF THE INVENTION

1. Field of the Invention

This invention relates to transfer switches and, more particularly, to transfer switches for selectively feeding power from one of two input lines to a load.

2. Background Information

Transfer switches are known in the art. See, for example, U.S. Pat. No. 5,397,868.

Transfer switches operate, for example, to transfer a power-consuming load from a circuit with a normal power supply to a circuit with an auxiliary power supply. Applications for transfer switches include stand-by applications, among others, in which the auxiliary power supply stands-by if the normal power supply should fail.

A transfer switch typically comprises a pair of circuit interrupters combined with a drive input and a linkage system. The preferred types of circuit interrupters have been molded-case switches and molded-case circuit breakers because these types are commercially available in a wide array of sizes and are relatively economical compared to other options. The preferred type of drive input depends on the application for the transfer switch. Usually motors are preferred, but at other times there is a clear preference for manually operated mechanisms.

In most residential and commercial buildings, the electrical wiring is only fed by a utility power source. In order to have a backup power source, such as a generator or inverter, it is necessary to provide a separate electrical back-up panel and, also, to re-wire the original panel. The cost of rewiring and the separate backup panel is great.

Accordingly, there is room for improvement in transfer switches.

SUMMARY OF THE INVENTION

These needs and others are met by the present invention, which provides a transfer switch that fits into existing circuit breaker panels without excessive wiring. The circuit breaker, which fits into existing electrical panels, has connections to allow such circuit breaker to supply the load with either a utility power source or a backup power source.

According to one aspect of the invention, a transfer switch comprises: a circuit breaker housing; a first line terminal; a second line terminal; a load terminal; a transfer arm adapted to move between a first position in which the transfer arm is electrically connected to the first line terminal and a second position in which the transfer arm is electrically connected to the second line terminal; means for moving the transfer arm between the first and second positions thereof; separable contacts electrically connected between the transfer arm and the load terminal; and an operating mechanism for opening and closing the separable contacts.

The housing may include a pivot point, and the transfer arm may include a first end, a second end and a pivot therebetween. The pivot pivotally engages the pivot point of the housing and is adapted to pivot the transfer arm between the first and second positions thereof. The means for moving the transfer arm may include a solenoid having a plunger, which engages the transfer arm between the pivot and one of the first and second ends thereof.

The housing may include a pivot point, and the transfer arm may include a first end, a second end and an intermediate portion therebetween. The first end has a pivot adapted for movement of the transfer arm between the first and second positions thereof, the second end has a first contact adapted for electrical connection with the first line terminal in the first position of the transfer arm and a second contact adapted for electrical connection with the second line terminal in the second position of the transfer arm. The intermediate portion of the transfer arm is adapted for movement by the means for moving the transfer arm. The means for moving the transfer arm may include a solenoid having a plunger which engages the transfer arm at the intermediate portion thereof.

As another aspect of the invention, a remotely controllable transfer switch comprises: a circuit breaker housing; a first line terminal; a second line terminal; a load terminal; a transfer arm adapted to pivot between a first position in which the transfer arm is electrically connected to the first line terminal and a second position in which the transfer arm is electrically connected to the second line terminal; a solenoid having a first coil, a second coil and a plunger engaging the transfer arm; a control circuit for the solenoid including a first terminal adapted to receive a first external signal, a second terminal adapted to receive a second external signal, and a third terminal adapted to receive a control voltage, the control circuit responsive to the first external signal to energize the first coil with the control voltage in order to move the plunger in a first direction to pivot the transfer arm to the first position thereof, the control circuit responsive to the second external signal to energize the second coil with the control voltage in order to move the plunger in a second direction to pivot the transfer arm to the second position thereof; separable contacts electrically connected between the transfer arm and the load terminal; and an operating mechanism for opening and closing the separable contacts.

The control circuit may further include a micro-switch having a normally open contact electrically connected in series with the first coil, a normally closed contact electrically connected in series with the second coil, and an operating member for switching the normally open contact and the normally closed contact. The normally closed contact and the normally open contact have a common terminal adapted to receive a control voltage to energize one of the first and second coils. The plunger of the solenoid has a projection which engages and actuates the operating member in the first position of the transfer arm, thereby causing the normally closed contact to open and the normally open contact to close.

The first terminal may be adapted for electrical connection with a first remote contact, which is referenced to a return of the control voltage. The second terminal may be adapted for electrical connection with a second remote contact, which is referenced to the return of the control voltage.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
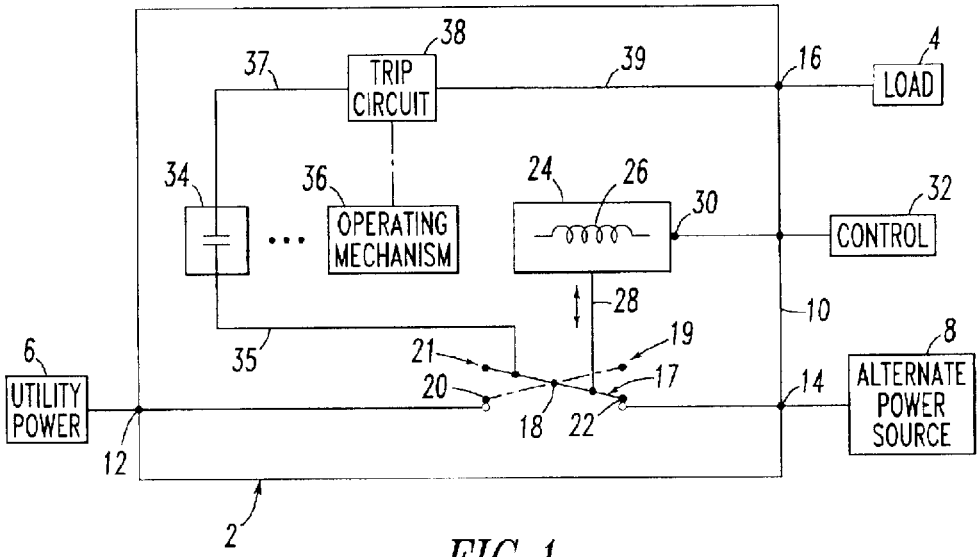
FIG. 1 is a block diagram of a transfer switch in accordance with an embodiment of the invention.

FIG. 1 shows a transfer switch 2 for switching a load 4 between a utility power line 6 and an alternate power source line 8. The exemplary transfer switch 2 is preferably housed in a circuit breaker housing, such as a miniature circuit breaker housing 10. Examples of miniature circuit breaker housings are disclosed in U.S. Pat. Nos. 5,301,083 and 5,373,411, which are incorporated by reference herein.

The transfer switch 2 includes a first line terminal 12 for electrical connection with the utility power line 6, a second line terminal 14 for electrical connection with the alternate power source line 8, and a load terminal 16 for electrical connection with the load 4. The transfer switch 2 further includes a transfer arm 17, which is suitably adapted to move (e.g., about pivot 18) between a first position 19 (shown in phantom line drawing) in which the transfer arm 17 is electrically connected through a first contact 20 to the first line terminal 12, and a second position 21 in which the transfer arm 17 is electrically connected through a second contact 22 to the second line terminal 14.

A suitable electro-mechanical actuator, such as the exemplary solenoid 24, has one or more coils 26, a plunger 28 and an input 30 adapted to receive one or more control signals 32 for the one or more coils 26. The plunger 28 suitably engages the transfer arm 17. Responsive to the one or more control signals 32, the plunger 28 moves the transfer arm 17 between the first and second positions 19, 21 thereof, in order to selectively electrically connect one of the utility power line 6 and the alternate power source line 8 with the load 4 through the transfer switch 2.

Independent of the transfer arm 17, a pair of separable contacts 34 is electrically connected by a suitable conductor 35 with the transfer arm 17. An operating mechanism 36 opens and closes the separable contacts 34. The separable contacts 34 are also electrically connected with the load terminal 16 by a conductor 37, a suitable trip circuit 38, and a conductor 39.

Figure 2:
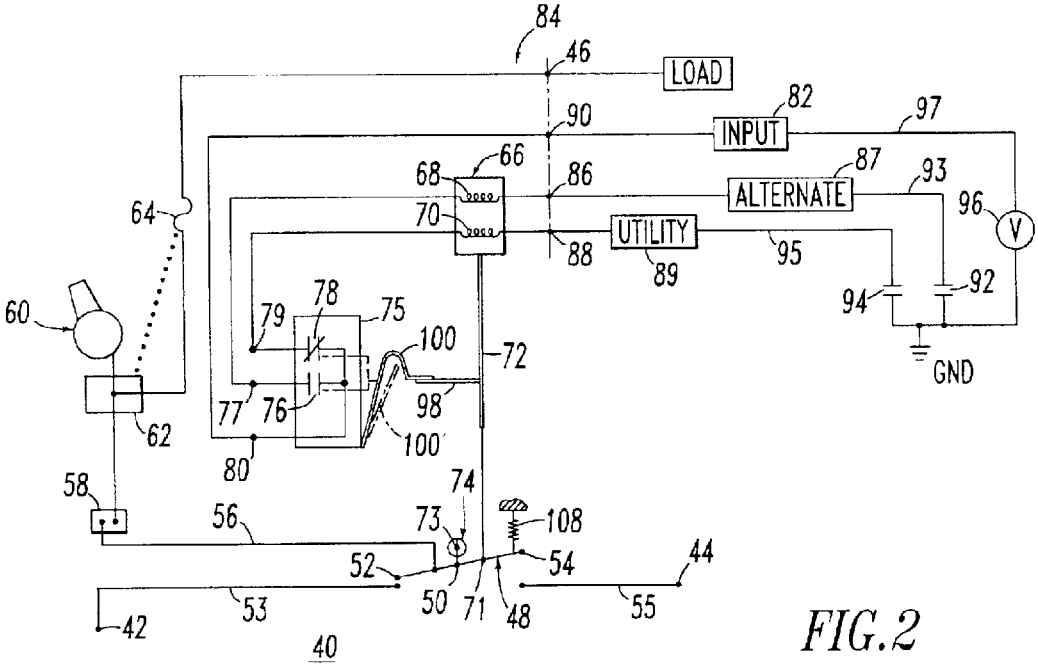
FIG. 2 is a block diagram of a transfer switch in accordance with another embodiment of the invention.

FIG. 2 shows a remotely controllable transfer switch (RCTS) 40 having two power inputs, utility line terminal 42 and alternate power source line terminal 44, and one output load terminal 46. The RCTS 40 has a transfer arm 48, which rotates about a pivot 50 and allows contact closure between a utility input contact 52 at one end of the transfer arm associated with a conductor 53 of the utility line terminal 42, or an alternate input contact 54 at the other end of the transfer arm associated with a conductor 55 of the alternate power source line terminal 44. A suitable flexible conductor 56 is electrically connected between the transfer arm 48 and a set of separable contacts 58. The separable contacts 58 are controlled manually (e.g., opened and closed) by an operating handle 60 through an operating mechanism 62, or automatically by a thermal/magnetic trip circuit 64. A maglatch or bi-directional solenoid 66 is linked to and controls the transfer arm 48.

Examples of the separable contacts 58, operating handle 60, operating mechanism 62, and thermal/magnetic trip circuit 64 are disclosed in incorporated by reference U.S. Pat. Nos. 5,301,083 and 5,373,411. Although a thermal/magnetic trip circuit 64 is shown, a thermal trip circuit and/or a magnetic trip circuit may be employed.

The exemplary solenoid 66 has a first coil 68, a second coil 70 and a plunger 72 engaging the transfer arm 48 at point 71 between the pivot 50 and the alternate input contact 54 end of the transfer arm. Alternatively, the plunger 72 may engage the transfer arm 48 at a point (not shown) between the pivot 50 and the utility input contact 52 end of the transfer arm. The pivot 50 pivotally engages a pivot point 73 of a suitable housing, such as a miniature circuit breaker housing 74, in order to enable the transfer arm 48 to pivot about the pivot point 73. The first solenoid coil 68 is adapted for energization to move the plunger 72 in a first downward direction (with respect to FIG. 2) to pivot the transfer arm 48 clockwise (with respect to FIG. 2) to the alternate input position thereof (not shown). The second solenoid coil 70 is adapted for energization to move the plunger 72 in a second upward direction (with respect to FIG. 2) to pivot the transfer arm 48 counter-clockwise (with respect to FIG. 2) to the utility position thereof (as shown in FIG. 2).

A suitable switch, such as the exemplary micro-switch 75, has normally open (NO) contacts 76 having a switched terminal 77 electrically connected in series with the first coil 68, and normally closed (NC) contacts 78 having a switched terminal 79 electrically connected in series with the second coil 70. The NC contacts 78 and the NO contacts 76 have a common terminal 80, which is adapted to receive a control voltage 82 to energize one of the first and second coils 68, 70.

A control circuit 84 for the solenoid 66 and the transfer arm 48 includes the micro-switch 75, a first terminal 86 adapted to receive a first external signal 87, a second terminal 88 adapted to receive a second external signal 89, and a third terminal 90 adapted to receive the control voltage 82. The micro-switch common terminal 80 is electrically connected to the third terminal 90 to receive the control voltage 82. With the NO contacts 76 closed (as discussed below), the control circuit 84 energizes the first coil 68 with the control voltage 82 responsive to the first external signal 87 (e.g., being at ground GND). Otherwise, with the NC contacts 78 closed, the control circuit 84 energizes the second coil 70 with the control voltage 82 responsive to the second external signal 89 (e.g., being at ground GND).

Remote control of the solenoid 66 is provided by inputting the control voltage 82 to the micro-switch 75, which is toggled (as discussed below) by the solenoid plunger 72. Depending on the position of the micro-switch 75, a voltage is present at either first coil 68 or second coil 70. One pair of the NO contacts 76 and the NC contacts 78 of the micro-switch 75 completes a circuit if either the alternate command input terminal 86 or the utility command input terminal 88 is closed to ground GND (e.g., through external and/or remote contacts 92, 94), which ground is the return of the input control voltage 82 (e.g., of external and/or remote voltage source (V) 96).

Whenever the solenoid plunger 72 is in a raised position (e.g., with respect to FIG. 2), the RCTS 40 is in a utility mode in which the utility line terminal 42 supplies power to the load terminal 46. The plunger 72 has a projection 98, which engages and actuates an operating member in the form of an actuating lever 100 of the micro-switch 75, thereby causing the NC contacts 78 to open and the NO contacts 76 to close. In turn, if the alternate command input terminal 86 is closed to ground, then the first coil 68 is energized. This moves the solenoid plunger 72 to a lowered position (e.g., with respect to FIG. 2), and switches the RCTS 40 to an alternate input mode in which the alternate power source line terminal 44 supplies power to the load terminal 46.

In the alternate mode, the plunger 72 de-actuates the micro-switch 75, thereby causing the NO contacts 76 to open and the NC contacts 78 to close. In turn, if the utility command input terminal 88 is closed to ground, then the second coil 70 is energized. This moves the solenoid plunger 72 to the utility position (e.g., raised with respect to FIG. 2), and switches the RCTS 40 to the utility mode in which the utility power source line terminal 42 supplies power to the load terminal 46. Again, the plunger 72 actuates the micro-switch 75, thereby causing the NC contacts 78 to open and the NO contacts 76 to close in preparation for possible input from the alternate command input terminal 86.

Figure 3:
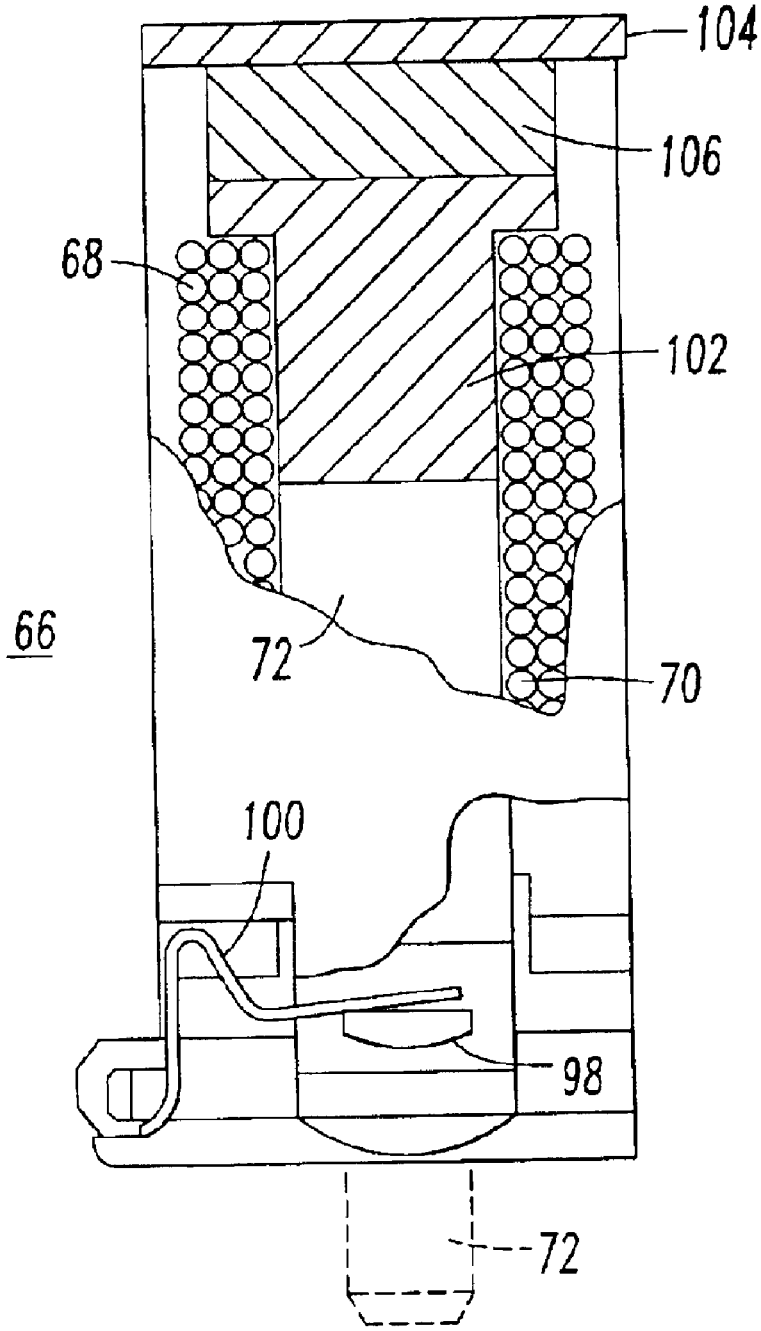
FIG. 3 PRIOR ART
FIG. 3 is a cross-sectional view of the solenoid of FIG. 2.

As shown by the partial cross-sectional view in FIG. 3, the actuator/solenoid 66 includes the first coil 68 and the second coil 70 concentrically wound on a steel core 102 supported by a steel frame 104. The plunger 72 moves rectilinearly within the coils 68 and 70. A permanent magnet 106 is seated between the steel core 102 and the steel frame 104.

When the first coil 68 is energized, a magnetic field is produced which negates the magnetic force produced by the permanent magnet 106. This allows the spring 108 to rotate or pivot the transfer arm 48 clockwise (with respect to FIG. 2) to the alternate position (not shown). This first electrically disconnects the contact 52 from the utility conductor 53 and then electrically connects the contact 54 to the alternate conductor 55. The transfer arm 48 is maintained in the clockwise or alternate position by a spring 108.

With the plunger 72 in the full upward position as shown in FIGS. 2 and 3, it contacts the steel core 102 and is retained in this position by the permanent magnet 106. Subsequently, when the first coil 68 is energized, the generated magnetic field negates the field generated by the permanent magnet 106 and, therefore, overrides the latter and with the spring 108 moves the plunger 72 back to the full downward position.

When the solenoid 66 is latched is in the upward position as shown in FIG. 2, the micro-switch 75 is actuated and the NO contacts 76 are closed while the NC contacts 78 are open. The first coil 68 is electrically connected between the first switched terminal 77 of the micro-switch 75 and the remotely located contact 92 through a lead 93. Similarly, the second coil 70 is electrically connected between the second switched terminal 79 of the micro-switch 75 and a remotely located contact 94 through lead 95. The common terminal 80 of the micro-switch 75 is electrically connected to the remotely located voltage source 96 through a lead 97.

When the solenoid plunger 72 is in the upward position (with respect to FIG. 2), the micro-switch 75 is actuated, and the NO contacts 76 are closed. Whenever the remote contact 92 is closed, the first coil 68 is energized from the voltage source 96. With energization of the first coil 68 and with the assistance of the spring 108, the plunger 72 is driven downward, which allows the actuating lever 100 of the micro-switch 75 to move to the open position 100' shown in phantom in FIG. 2. This results in opening of the NO contacts 76 (and closure of the NC contacts 78) to interrupt current flow in the first coil 68. However, the transfer arm 48 remains latched in the clockwise position due to the spring 108.

With the NC contacts 78 now closed, the second coil 70 is enabled by application of the voltage from the voltage source 96. However, no current flows through the second coil 70 until the remote contact 94 is closed to complete the circuit for the second coil 70. When it is desired to transfer to the counter-clockwise or utility position, the second coil 70 is energized, which raises the plunger 72 in order to pivot the transfer arm 48 to the counter-clockwise position. This first electrically disconnects the contact 54 from the alternate conductor 55 and then electrically connects the contact 52 to the utility conductor 53.

The exemplary micro-switch 75 advantageously functions as an internal power cutoff device. Since the solenoid 66 latches in the upper position (through the magnet 106) and in the lower position (through the spring 108), only momentary power is needed to operate the solenoid 66. Any suitable alternating current (AC), direct current (DC) or pulse voltage source may provide such momentary power. Accordingly, momentary signals 87, 89 can be used to control operation of the solenoid 66.

Although remote contacts 92, 94 are shown, such contacts can be manual switches or automatic switches, such as output contacts of a computer system. As an alternative arrangement (not shown), the contacts 92, 94 can be eliminated so that the coils 68, 70 are connected directly between the respective micro-switch terminals 77, 79 and ground GND. In this arrangement, the position of the solenoid plunger 72 is toggled by successive momentary signals generated by the voltage source 96.

Further flexibility is available when it is considered that the coupling between the solenoid plunger 72 and the micro-switch 75 can be arranged so that the actuating lever 100 is actuated when the plunger 72 is in the downward position (with respect to FIG. 2) and the transfer arm 48 is in the alternate input position (not shown).

Although an exemplary solenoid 66 is shown, a wide range of actuators for the transfer arm 48 may be employed such as, for example, solenoids having opening and holding coils and an external bias spring as disclosed in U.S. Pat. Nos. 5,301,083 and 5,373,411; and solenoids having a single coil which is energized with a first polarity voltage to raise a plunger to pivot a transfer arm counter-clockwise and which is energized with an opposite second polarity voltage to lower such plunger to pivot such transfer arm clockwise. As an alternative to the solenoids, a suitable electric motor driving a gear and rack may be employed to pivot a transfer arm. In this example, the motor has a winding which may be energized with a certain polarity voltage to rotate the gear in one of two rotational directions. With the rotation of the gear, the rack moves in one of two corresponding linear directions similar to the solenoid plunger 72 to pivot the transfer arm.

Figure 4:
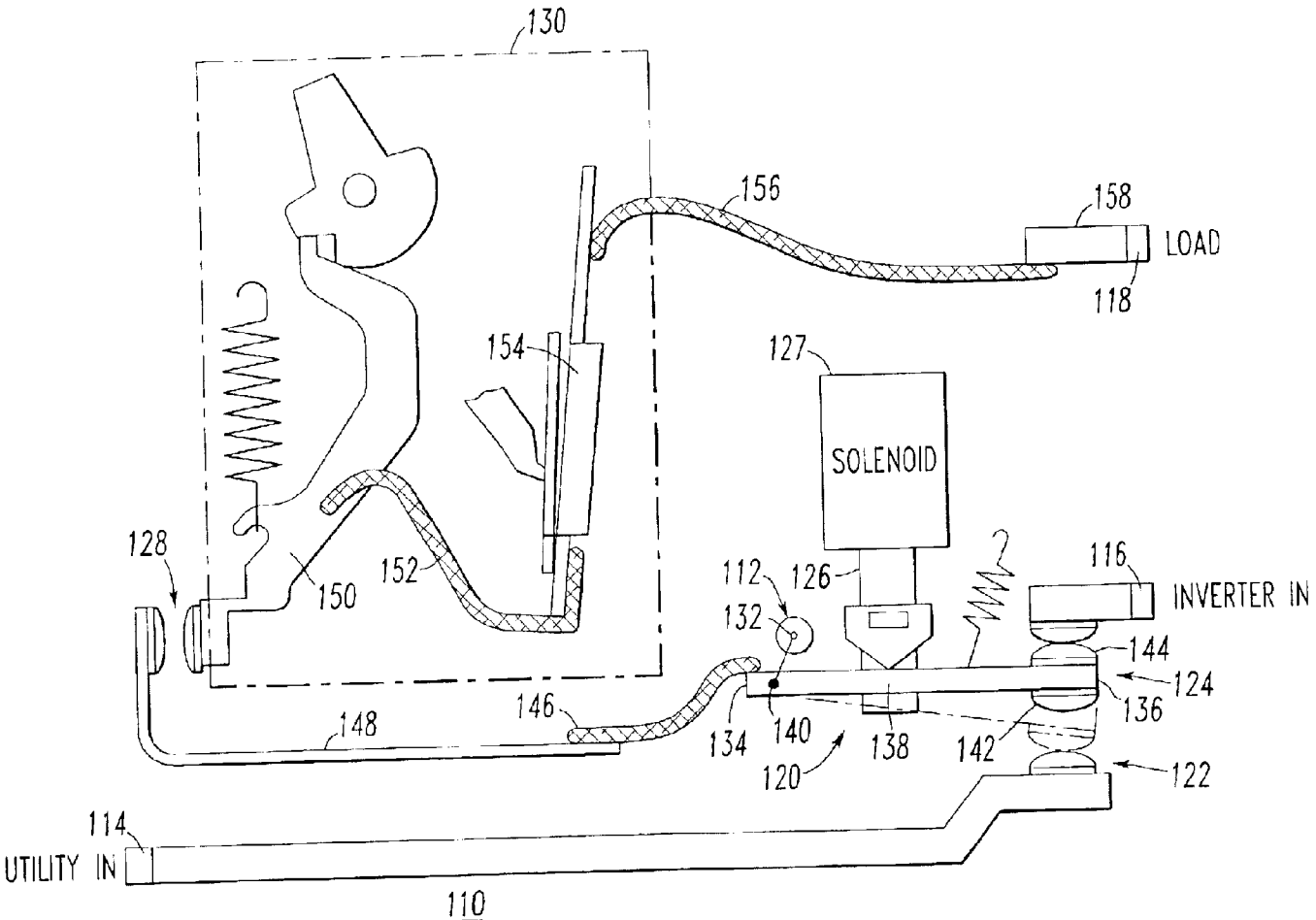
FIG. 4 is a block diagram of a transfer switch in accordance with another embodiment of the invention.

Referring to FIG. 4, a transfer switch 110 includes a circuit breaker housing 112, a first line terminal (e.g., UTILITY IN) 114, a second line terminal (e.g., INVERTER IN) 116, a load terminal 118, and a transfer arm 120 adapted to move between a first position 122 (shown in phantom line drawing) in which the transfer arm is electrically connected to the first line terminal 114 and a second position 124 in which the transfer arm is electrically connected to the second line terminal 116. A plunger 126 of a solenoid 127 moves the transfer arm 120 between the first and second positions 122, 124 thereof. Separable contacts 128 are electrically connected between the transfer arm 120 and the load terminal 118. An operating mechanism 130 opens and closes the separable contacts.

The housing 112 has a pivot point 132. The transfer arm 120 includes a first end 134, a second end 136 and an intermediate portion 138 therebetween. The first end 134 of the transfer arm 120 has a pivot 140 adapted for movement of the transfer arm between the first and second positions 122, 124 thereof. The second end 136 of the transfer arm 120 has a first contact 142 adapted for electrical connection with the first line terminal 114 in the first position 122 of the transfer arm 120 and an opposing second contact 144 adapted for electrical connection with the second line terminal 116 in the second position 124 of the transfer arm 120. The intermediate portion 138 of the transfer arm 120 is adapted for movement by the solenoid plunger 126, which engages the transfer arm 120 at the intermediate portion 138 thereof.

An electrically conductive path between the transfer arm 120 and the load terminal 118 includes a flexible conductor 146, a conductor 148, the separable contacts 128, a movable contact arm 150, a flexible conductor 152, a bimetal 154, a flexible conductor 156, and a load terminal conductor 158.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A remotely controllable transfer switch comprising:

a circuit breaker housing;

a first line terminal;

a second line terminal;

a load terminal;

a transfer arm adapted to pivot between a first position in which said transfer arm is electrically connected to said first line terminal and a second position in which said transfer arm is electrically connected to said second line terminal;

a solenoid having a first coil, a second coil and a plunger engaging said transfer arm;

a control circuit for said solenoid including a first terminal adapted to receive a first external signal, a second terminal adapted to receive a second external signal, and a third terminal adapted to receive a control voltage, said control circuit responsive to said first external signal to energize said first coil with said control voltage in order to remove said plunger in a first direction to pivot said transfer arm to the first position thereof, said control circuit responsive to said second external signal to energize said second coil with said control voltage in order to move said plunger in a second direction to pivot said transfer arm to the second position thereof;

separate contacts electrically connected between said transfer arm and said load terminal;

an operating mechanism for opening and closing said separable contacts; and wherein said control circuit further includes a microswitch having a normally open contact electrically connected in series with the first coil, a normally closed contact electrically connected is series with the second coil, and an operating member for switching said normally open contact and said normally closed contact, said normally closed contact and said normally open contact having a common terminal electrically connected to said third terminal to receive said control voltage to energize one of the first and second coils; and wherein the plunger at said solenoid has a projection which engages and actuates the operating member in the first position of said transfer arm, thereby causing said normally closed contact to open and said normally open contact to close.

2. A remotely controllable transfer switch comprising:

a circuit breaker housing;

a first line terminal;

a second line terminal;

a load terminal;

a transfer arm adapted to pivot between a first position in which said transfer arm is electrically connected to said first line terminal and a second position in which said transfer arm is electrically connected to said second line terminal;

a solenoid having a first coil, a second coil and a plunger engaging said transfer arm;

a control circuit for said solenoid including a first terminal adapted to receive a first external signal, a second terminal adapted to receive a second external signal, and a third terminal adapted to receive a control voltage, said control circuit responsive to said first external signal to energize said first coil with said control voltage in order to move said plunger in a first direction to pivot said transfer arm to the first position thereof, said control circuit responsive to said second external signal to energize said second coil with said contact voltage in order to move said plunger in a second direction to pivot said transfer arm to the second position thereof;

separable contacts electrically connected between said transfer arm and said load terminal;

an operating mechanism for opening and closing said separable contacts; and wherein the control voltage has a return; wherein the first terminal is adapted for electrical connection with a first remote contact which is referenced to the return of the control voltage; and wherein the second terminal is adapted for electrical connection with a second remote contact which is referenced to the return of the control voltage.

* * * * *